US011190883B2

(12) United States Patent
Goekay et al.

(10) Patent No.: US 11,190,883 B2
(45) Date of Patent: Nov. 30, 2021

(54) METHOD FOR OPERATING A HEARING DEVICE, AND HEARING DEVICE

(71) Applicant: SIVANTOS PTE. LTD., Singapore (SG)

(72) Inventors: Umut Goekay, Koenigswinter (DE); Frank Naumann, Bubenreuth (DE); Henning Puder, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/018,260

(22) Filed: Sep. 11, 2020

(65) Prior Publication Data

US 2021/0076143 A1 Mar. 11, 2021

(30) Foreign Application Priority Data

Sep. 11, 2019 (DE) ..... 102019213810

(51) Int. Cl.

| | |
|---|---|
| ***H04R 25/00*** | (2006.01) |
| ***G10L 21/0216*** | (2013.01) |
| ***H04R 1/10*** | (2006.01) |
| ***H04R 3/04*** | (2006.01) |

(52) U.S. Cl.

CPC ..... *H04R 25/50* (2013.01); *G10L 21/0216* (2013.01); *H04R 1/1083* (2013.01); *H04R 3/04* (2013.01)

(58) Field of Classification Search

CPC ..... H04R 25/50; H04R 1/1083; H04R 3/04; G10L 21/0216

See application file for complete search history.

(56) References Cited

U.S. PATENT DOCUMENTS

| | | | | |
|---|---|---|---|---|
| 6,658,122 | B1 | 12/2003 | Westermann et al. | |
| 7,082,205 | B1 | 7/2006 | Westermann | |
| 7,433,481 | B2 | 10/2008 | Armstrong et al. | |
| 7,574,012 | B2 | 8/2009 | Eggers et al. | |
| 8,229,127 | B2 | 7/2012 | Jergensen et al. | |
| 2012/0070024 | A1 | 3/2012 | Anderson | |
| 2017/0042739 | A1* | 2/2017 | O'Neill | A61F 11/04 |

(Continued)

FOREIGN PATENT DOCUMENTS

| | | |
|---|---|---|
| EP | 1129600 B1 | 9/2004 |
| EP | 1129601 B1 | 5/2007 |

(Continued)

*Primary Examiner* — Andrew L Sniezek

(74) *Attorney, Agent, or Firm* — Laurence A. Greenberg; Werner H. Stemer; Ralph E. Locher

(57) ABSTRACT

A method for operating a hearing device is specified. The hearing device has at least one microphone that picks up an input sound signal and converts it into an electrical input signal. The hearing device has a signal processing section that modifies the electrical input signal on the basis of an audiogram of a user and thereby generates a first electrical output signal. The hearing device has an active noise reduction system that generates a second electrical output signal in order to reject a noise component. The hearing device has a receiver that converts the first electrical output signal and the second electrical output signal into an output sound signal, for output to the user. The active noise reduction system is operated in parallel with the signal processing section. A corresponding hearing device is programmed to perform the method.

15 Claims, 3 Drawing Sheets

(56) References Cited

U.S. PATENT DOCUMENTS

| | | | |
|---|---|---|---|
| 2018/0184219 | A1 | 6/2018 | Van Der Werf |
| 2020/0252734 | A1 | 8/2020 | Elmedyb et al. |

FOREIGN PATENT DOCUMENTS

| | | | |
|---|---|---|---|
| EP | 1542500 | B1 | 12/2010 |
| EP | 2023664 | B1 | 3/2013 |
| EP | 1251714 | B2 | 6/2015 |
| WO | 2018141559 | A1 | 8/2018 |

* cited by examiner

METHOD FOR OPERATING A HEARING DEVICE, AND HEARING DEVICE

CROSS-REFERENCE TO RELATED APPLICATION

This application claims the priority, under 35 U.S.C. § 119, of German patent application DE 10 2019 213 810, filed Sep. 11, 2019; the prior application is herewith incorporated by reference in its entirety.

BACKGROUND OF THE INVENTION

Field of the Invention

The invention relates to a method for operating a hearing device and to a hearing device suitable therefor.

A hearing device is used to output sounds to a user of the hearing device. To this end, the user wears the hearing device on or in his ear. To output sounds, the hearing device has a receiver and at least one microphone in order to pick up sounds from the surroundings and then to output the sounds to the user. The sounds are additionally modified by the hearing device to compensate for a hearing loss of the user. The hearing device is therefore also referred to as hearing aids.

Hearing devices are described by way of example in European patents EP 1 129 600 B1 (corresponding to U.S. Pat. No. 6,658,122), EP 1 29 601 B1 (corresponding to U.S. Pat. No. 7,082,205), EP 1 251 714 B2 (corresponding to U.S. Pat. No. 7,433,481), EP 2 023 664 B1 (corresponding to U.S. Pat. No. 8,229,127), international patent disclosure WO 2018/141559 A1 (corresponding to U.S. patent publication No. 2020/0252734) and U.S. Pat. No. 7,574,012 B2.

A hearing device can additionally have an active noise reduction system, e.g. an ANC (active noise cancellation) or an AOR (active occlusion reduction). An ANC rejects sounds from the surroundings, specifically noise, i.e. noise components, so that the result for the user is a quietened hearing situation. An AOR also produces a quietened hearing situation in a similar manner. An ANC involves sounds being rejected that enter the auditory canal of the user externally from the surroundings. By contrast, an AOR involves such sounds as are produced by the user himself or as result from standing waves in the auditory canal being rejected. This is the case particularly if the auditory canal is predominantly or completely sealed from the surroundings by an earmold. The AOR is accordingly primarily an internal noise reduction system that rejects noise in the auditory canal, and the ANC is an external noise reduction system that rejects noise from outside the auditory canal. In both cases the actual noise reduction is achieved inside the auditory canal, however, by generating an inverted signal that is acoustically overlaid on the noise in the auditory canal and then cancels out the noise. Overall, in both cases, such sounds as the user usually perceives as a nuisance are rejected and this produces a quietened hearing situation.

European patent EP 1 542 500 B1, corresponding to U.S. Pat. No. 7,584,012, describes a hearing device having a signal processing device that performs signal processing on a useful signal, the useful signal having previously been freed of noise by a noise reduction system.

A combination of conventional hearing device operation, in which a hearing loss is compensated for, and an ANC or AOR is not readily possible on account of different objectives for the processing of an input signal. While the hearing device compensates for the hearing loss typically by amplifying ambient sounds, at least some of the ambient sounds are rejected by an ANC or AOR. Since the result of the various signal modifications is intended to be output by way of a joint receiver of the hearing device, disadvantageous interference effects are sometimes obtained there.

BRIEF SUMMARY OF THE INVENTION

Against this background, it is an object of the invention to specify an improved method for operating a hearing device. The method is intended to involve signal processing by the hearing device for compensating for a hearing loss being combined with active noise reduction in as optimum a fashion as possible. A corresponding hearing device suitable for performing the method is also intended to be specified.

The object is achieved by a method having the features of the independent claims. Advantageous configurations, developments and variants are the subject of the subclaims. The explanations in connection with the method also apply mutatis mutandis to the hearing device, and vice versa. Where method steps are described below, advantageous configurations are obtained for the hearing device in particular by virtue of the hearing device being configured to carry out one or more of these method steps. The components that may be used for this purpose are advantageously parts of the hearing device.

The method is used for operating a hearing device. The hearing device has at least one microphone in particular an external microphone, that picks up an input sound signal and converts it into an electrical input signal. The hearing device also has a signal processing section that modifies the electrical input signal on the basis of an audiogram of a user and thereby generates a first electrical output signal. The input signal is preferably modified in a modification unit, which is a part of the signal processing section. The hearing device furthermore has an active noise reduction system that generates a second electrical output signal in order to reject a noise component. The first and second electrical output signals are each also referred to simply as output signal for short. The hearing device moreover has a receiver that converts the first electrical output signal and the second electrical output signal into an in particular joint output sound signal, for output to the user. The output sound signal is thus an acoustic output signal. The second electrical output signal is in particular in a form such that a noise component in the output sound signal is rejected. The noise component is for example an ambient sound and generally not a useful signal. The noise component is either a part of the aforementioned input sound signal or a part of another input sound signal, picked up by means of an additional microphone.

The active noise reduction system is also referred to simply as a noise reduction system in the present case for short. The active noise reduction system is preferably an ANC (short for "active noise cancelling") or an AOR (short for "active occlusion reduction") or both. The active noise reduction system is operated in parallel with the signal processing section.

In the hearing device, the method for operating same accordingly involves an output sound signal for the user of the hearing device being generated by virtue of one or more input sound signals first being picked up from the surroundings by means of one or more microphones. The respective microphone generates from the acoustic input sound signal an electrical input signal that is forwarded to the signal processing section. The signal processing section modifies the input signal and generates the first electrical output signal therefrom. This output signal is accordingly a modified input signal. The modification is in particular dependent on the individual hearing loss of the user and is achieved on the basis of an accordingly equally individual audiogram. The audiogram is ascertained in advance of use, for example, in the course of a fitting session. The audiogram is expediently in a form such that during operation of the hearing device a useful component, in particular voice, is emphasized for the user. The audiogram is advantageously stored in a memory, which is in particular a part of the hearing device, and is then accessible to the signal processing section during operation. The signal processing section derives from the audiogram for example a frequency-dependent gain factor that is used to amplify the input signal. Alternatively or additionally, one or more filters are applied to the input signal in order e.g. to modify the input signal on a frequency-selective basis. The output signal is finally forwarded to the receiver, which is driven by the output signal and outputs a corresponding acoustic output sound signal. The procedure containing pickup of the input sound signal, generation of the input signal therefrom, modification of the input signal, resultant generation of the output signal and subsequent generation of the output sound signal is all in all a hearing device function that is a core functionality of the hearing device.

The hearing device function also inherently outputs any noise components contained in the input sound signal as noise components in the output sound signal too, following appropriate modification. It is fundamentally possible and advantageous to reduce a noise component by means of the signal processing section, for example by means of an appropriate filter or the like. Such reduction of a noise component by the signal processing section is achieved electronically, however, and inherently does not capture noise components that enter the auditory canal past the hearing device or arise in the auditory canal, but rather captures only noise components that are also picked up by the microphone of the hearing device and forwarded to the signal processing section. In this respect, a reduction of a noise component by the signal processing section is complementary to the active noise reduction performed in the present case and is therefore performed in addition thereto in one advantageous configuration.

The signal processing section requires a certain processing time in order to modify the input signal. The processing time is accordingly in particular a delay as a result of the modification unit. The processing time is ideally as short as possible, in order to avoid a delayed output as far as possible. Since at least a portion of the input sound signal normally enters the auditory canal, this portion is overlaid with the output sound signal. Due to the signal processing, the input sound signal and the output sound signal are then offset in time by a time lag. If the processing time of the signal processing section is too long, the time lag is perceptible to the user and is typically sensed as a nuisance. A benchmark for an upper limit of the processing time is 10 ms, values above this typically being unacceptable to the user. Accordingly, it is therefore a fundamental aim to perform the signal processing as quickly as possible and to reduce the processing time and accordingly the time lag as far as possible. A processing time of 1 ms or less is possible and advantageous, this regularly being imperceptible and leading to an accordingly good listening experience for the user.

The active noise reduction system behaves toward the signal path in a fundamentally similar manner to the signal processing section for the hearing device function. The noise reduction system also initially involves one or more input sound signals, that is to say acoustic input signals, being picked up from the surroundings by means of one or more microphones, these microphones not necessarily being the same as for the hearing device function. In this case too, the input sound signal typically has a noise component. The respective microphone generates from the input sound signal an electrical input signal that accordingly also contains the noise component and that is forwarded to the noise reduction system. The latter analyses the input signal and generates therefrom an electrical output signal, in particular the aforementioned second electrical output signal, which is then the opposite of the input signal or at least portions thereof, specifically the noise component. The output signal from the noise reduction system is accordingly basically in particular an inverted input signal. The output signal is finally forwarded to a receiver of the hearing device, which receiver is driven by the output signal and outputs a corresponding output sound signal that is accordingly inverted with respect to the input sound signal and thereby cancels out, i.e. ultimately rejects, the noise component. The procedure containing pickup of the input sound signal, generation of the input signal therefrom, analysis of the input signal, resultant generation of the output signal to reject a noise component and subsequent generation of the output sound signal is all in all a noise reduction function.

The active noise reduction system now differs from the signal processing section in particular in that the noise reduction system aims to modify a sound signal and, to this end, actuates the receiver accordingly, whereas the signal processing section aims to modify an electrical signal so that a specific sound signal is output. The noise component actually rejected by the noise reduction system is thus basically outside the hearing device. The output sound signal from the noise reduction system is output via the same receiver as the output sound signal from the signal processing section. The receiver is then actuated both with the first and with the second electrical output signal, i.e. the two output signals are overlaid and collectively supplied to the receiver, which then generates a corresponding output sound signal therefrom. Effectively, the receiver is accordingly all in all actuated by means of a joint output signal and outputs a joint output sound signal. This output sound signal then contains firstly a user component, which is generated for the user individually by the signal processing section on the basis of the audiogram, and secondly a rejection component, which rejects noise components, i.e perturbing sound signals e.g. from the surroundings or from the user, in the auditory canal. The cancellation of a noise component by the noise reduction system takes place in the acoustic domain, i.e. outside the hearing device and directly by means of sound waves being overlaid, and distinctly not in the electrical signal domain as a result of cancellation of electrical signals.

Two variants of the active noise reduction system are particularly preferred in the present case, these preferably being combined, but also advantageously being able to be used independently of one another and individually. The first variant is an ANC, i.e. an active noise cancellation, which involves rejecting ambient sounds that enter the auditory canal from the outside and past an earmold that may be present for the hearing device and represent a noise component. The input signal is generated either using the same microphone as the input signal for the signal processing section or by means of another, additional microphone. The second variant is an AOR, i.e. an active occlusion reduction, which involves rejecting sounds in the auditory canal, above all inherent sounds, i.e. sound signals that are produced by the user himself, or standing waves inside a predominately sealed auditory canal. In this instance, the input signal for the noise reduction system is generated in particular by means of an internal microphone and not using that microphone that generates the input signal for the signal processing section. The first variant is also referred to as "feedforward" rejection, the second variant as "feedback" rejection. The difference between the two variants is in particular the arrangement of the microphone for picking up the input sound signal relative to the auditory canal. In the case of the ANC the microphone is directed outward and typically arranged outside the auditory canal, whereas in the case of the AOR the microphone is directed inward and arranged in the auditory canal. The boundary between "inside" and "outside" is defined in particular by an earmold of the hearing device, which sits in the auditory canal and bounds a volume therein, which is inside, in contrast to the surroundings on the other side of the earmold, which are outside. The output in both cases is provided inward, in particular by virtue of the applicable receiver being directed inward into the auditory canal for this purpose.

For the active noise reduction system too, it is advantageous for the processing time thereof to be as short as possible. This stems from the fact that the output sound signal inherently needs to be overlaid with the input sound signal in a specific manner in order to obtain a maximum effect, that is to say maximum cancellation. Any delay before the output sound signal is output leads to an additional phase shift between the output sound signal and the input sound signal, with the result that the overlay is not optimum and the cancellation is accordingly incomplete. This problem increases as frequency rises, since for higher frequencies the same delay leads to a greater phase shift. Feasible and also suitable processing times for an active noise reduction system, whether ANC or AOR, are in the range from 50 μs to 150 μs.

When the hearing device function is combined with the noise reduction function, specific problems arise that do not occur in this form when the respective function is implemented individually. The problems result in particular from the different objective of the two functions and the overlap therein on the part of the input sound signal and/or the output sound signal. In general, the hearing device is configured, as described, such that it takes the hearing device function as a basis for using the input sound signal to output a specific and normally amplified output sound signal. By contrast, the noise reduction system is configured such that it is supposed to cancel out a sound signal. If an external sound signal is intended to be rejected as part of an ANC, then both the noise reduction and the signal processing are based on the same input sound signal or at least on predominantly similar input sound signals and to that extent are correlated, so that conflicting actuation and output, as it were, arises at the receiver, leading to disadvantageous interference effects in the output sound signal. If an internal sound signal is intended to be cancelled as part of an AOR, on the other hand, then the internal sound signal also contains the output sound signal from the signal processing section, however, and the noise reduction system effectively rejects the hearing device function.

On the other hand, the problems described do not exist in the case of e.g. conventional media players, in which a digital or analogue audio signal is converted into an output sound signal and output. In the case of an ANC, the audio signal has no correlation at all with the input sound signal, which means that inherently no interference effects occur in this case. An AOR is also possible without any difficulty. Although the converted audio signal is contained in the input sound signal picked up inside, the pure audio signal is known, of course, and can therefore be compared with the electrical input signal so as then, after an appropriate comparison, to identify a signal excess as a noise component and subsequently cancel it selectively by means of appropriate actuation of the receiver.

In order to provide both a hearing device function and a noise reduction function in a hearing device, the signal processing section and the active noise reduction system are operated in parallel in the present case. This is understood to mean that the signal processing section and the active noise reduction system are operated independently of one another, i.e. they form two mutually separate processing blocks inside the hearing device. The signal processing section and the active noise reduction system are each in the form of an electronic circuit and the two circuits are arranged at different points on a microchip or even on different microchips. The two circuits for providing the hearing device function, on the one hand, and the noise reduction function, on the other hand, are therefore physically separate. The active noise reduction system is distinctly not part and not a subfunction of the signal processing section, but rather operates independently thereof in principle. The parallel operation means that the active noise reduction system does not intervene in the modification of the input signal by the signal processing section, and conversely the signal processing section also does not intervene in the generation of the output signal from the noise reduction system. In other words: the pure generation of the output signal by the signal processing section is uninfluenced by the active noise reduction system and conversely the pure generation of the output signal by the active noise reduction system is uninfluenced by the signal processing section. The hearing device function and the noise reduction function are therefore implemented in particular as parallel processes in the hearing device.

There is particular preference for a configuration in which the hearing device has a delay unit, in order to set a time difference between the first output signal and the second output signal and therefore in particular also between the respective conversion of the signals by the receiver. The hearing device therefore has an adjustable time difference. Here, "adjustable" is understood to mean that at least two different values are settable for the time difference. In a particularly simple, suitable configuration a firm value is predefined for the time difference and the value is therefore adjustable by virtue of the delay unit being either activated or deactivated, that is to say the firmly predefined time difference being either added or not added. A configuration in which the time difference is adjustable within a predefined range, in particular during operation of the hearing device, is also suitable. The delay unit is integrated in the signal processing section or in the noise reduction system or arranged outside these two. A combination of these is also possible and suitable by virtue of the delay unit having multiple subunits that are formed separately from one another and that collectively produce the time difference. The delay unit and the adjustable time difference allow the first and second electrical output signals to be delayed relative to one another such that the above-described disadvantages of simultaneous operation of the signal processing section and the active noise reduction system are advantageously reduced. The delay unit is therefore used in particular to reduce a correlation between the output signals.

The time difference is preferably set such that a correlation between the first and second output signals is minimized. To control the delay unit and in particular to set the time difference, the hearing device preferably has a correlation measurement unit that determines a correlation between the first and second output signals and actuates the delay unit so that a time difference is set that minimizes the correlation.

In an expedient configuration the delay unit has a ring buffer or is in the form of such. The ring buffer is distinguished in particular in that it is used to store the output signals in succession and to output them again in the order in which they arrive, but at a specific time and therefore with a specific time delay, namely the time difference. The ring buffer is accordingly a buffer store for the output signals.

It is assumed in the present case, without restricting the generality, that the signal processing section has a longer processing time than the noise reduction system. The concepts described are, however, fundamentally also analogously applicable to hearing devices in which the noise reduction system conversely has a longer processing time than the signal processing section, so that the time difference is then expediently added to the processing time of the noise reduction system, or to hearing devices in which the signal processing section and the noise reduction system have similar processing times, i.e. in particular differ from one another by no more than 50%.

A configuration in which the time difference is set in a range from 2 ms to 5 ms is particularly suitable. This range is a good compromise between low correlation and hence low interference, on the one hand, and a short delay of the hearing device function, on the other hand. For an exemplary delay time of 1 ms for the signal processing section the sum of the processing time of the signal processing section and the time difference is then no more than 6 ms, which means that a good hearing experience is still provided. At the same time, the time difference is sufficiently great to adequately reduce the correlation between the two output signals.

In a particularly preferred configuration the hearing device has two modes of operation, namely a rejection mode, in which the active noise reduction system is activated, and a normal mode, in which the active noise reduction system is deactivated. The time difference of the delay unit is set such that a delay between the input signal of the signal processing section and the output signal thereof is greater in the rejection mode than in the normal mode. In this configuration the adjustable time difference is accordingly chosen to be as small as possible in the normal mode in order to ensure the best possible hearing experience, the by and large small time difference being possible primarily by virtue of the noise reduction system being deactivated and therefore no interference and correlation effects being able to occur. Preferably, the delay unit is also deactivated in the normal mode and the adjustable time difference is therefore 0 ms. In the rejection mode the processing time of the signal processing section then consciously has the additional time difference added to it, so that the interference and correlation effects that potentially occur are reduced.

A configuration in which the hearing device has multiple modes of operation in which the signal processing section has a different processing time in each case, and wherein the time difference added by the delay unit is then set on the basis of the mode of operation and hence on the basis of the respective processing time, is also particularly expedient. Expediently, in the respective mode of operation—and provided that the noise reduction system is activated—the time difference is set to be greater the shorter the respective processing time. Different processing times are obtained for example on the basis of a supplementary function that is activated in one mode of operation while being deactivated in another mode of operation.

The delay unit and the additional time difference are particularly advantageous in a hearing device having a signal processing section that has a particularly short processing time. In a preferred configuration the signal processing section of the hearing device has a processing time of no more than 2 ms, particularly preferably of no more than 1 ms. The processing time indicates the time delay owing to the modification of the input signal. Typically, the delay time corresponds by and large to the delay between the input signal and the output signal of the signal processing section, in which case the possibly additional time difference of the delay unit is logically not included, especially if the delay unit is integrated in the signal processing section. Such a short delay time is achieved in particular by virtue of computation-intensive supplementary functions of the signal processing section being deactivated, so that the processing time is determined exclusively or predominantly by the modification of the input signal on the basis of the audiogram.

Parallel operation of the signal processing section and the active noise reduction system can be implemented in different ways. Different suitable configurations are obtained in particular in respect of the following three aspects: first, by the selection of microphones and the respective connection thereof to the signal processing section and the noise reduction system. Second, by the type of combination of the two output signals. Third, by the specific configuration, arrangement and control of the delay unit. A few suitable configurations of these three aspects are specified below. The different configurations in respect of the three cited aspects are fundamentally independent of one another and arbitrarily combinable with one another.

Preferably, the hearing device has at least one external microphone that generates an input signal that is forwarded both to the signal processing section and to the noise reduction system. The signal processing section generates the first output signal on the basis of the input signal and the noise reduction system generates the second output signal on the basis of the input signal. In an expedient development the hearing device has two external microphones, namely a first external microphone and a second external microphone. The external microphones each generate an input signal that is forwarded both to the signal processing section and to the noise reduction system. The signal processing section therefore generates the first output signal on the basis of the two input signals from the external microphones and the noise reduction system generates the second output signal on the basis of the same two input signals from the external microphones.

Alternatively, a configuration in which the hearing device has at least two external microphones, namely a first external microphone and a second external microphone, wherein the two external microphones each generate an input signal, namely a first input signal and a second input signal, one of which is forwarded to the signal processing section, while the other is forwarded to the noise reduction system, is also advantageous. In particular, neither of the two input signals is forwarded both to the signal processing section and to the noise reduction system. The signal processing section generates the first output signal on the basis of one input signal and the noise reduction system generates the second output signal on the basis of the other input signal. In an expedient development, the hearing device has three external microphones, namely a first external microphone, a second external microphone and a third external microphone. The external microphones each generate an input signal that is forwarded either to the signal processing section or to the noise reduction system in each case. Preferably, the input signals from the first and second microphones are forwarded to the signal processing section and the input signal from the third microphone is forwarded to the noise reduction system. The signal processing section therefore generates the first output signal on the basis of the two input signals from the first and second external microphones and the noise reduction system generates the second output signal on the basis of the input signal from the third external microphone.

In comparison with the configuration in which an input signal is forwarded both to the signal processing section and to the noise reduction system, the signal processing section and the noise reduction system advantageously use the input signals from different external microphones in the configuration cited as an alternative thereto, which means that there is already a reduced correlation at the input. A certain correlation is regularly still present, however, since the microphones continue to be comparatively close to one another, e.g. no further than 1 cm away from one another, on account of the size of the hearing device and pick up at least similar input sound signals.

In the aforementioned configurations having one or more external microphones, it has been assumed that the noise reduction system is an ANC. In an equally suitable configuration, the noise reduction system is alternatively or additionally an AOR. In such a configuration, the hearing device has an internal microphone that generates an input signal that is supplied to the noise reduction system, which then generates the second output signal on the basis of the input signal from the internal microphone. The internal microphone is also referred to as an ear canal microphone.

The configurations having external microphones are arbitrarily combinable with the configuration having an internal microphone, which means that the noise reduction system is then both an ANC and an AOR and the second output signal is generated both on the basis of at least one input signal from an external microphone and on the basis of an input signal from an internal microphone.

In one advantageous configuration, the first output signal and the second output signal are combined with one another, in particular added to one another, outside the signal processing section and the noise reduction system and forwarded to the receiver, which finally generates and outputs a corresponding output sound signal.

By contrast, the noise reduction system in an equally suitable, alternative configuration has an audio input by way of which the first audio signal from the signal processing section is routed to the noise reduction system, so that the first output signal is a further input signal for the latter. In the noise reduction system the second output signal is then generated on the basis of the input signals from the microphones and combined with the first output signal, so that the noise reduction system then outputs a joint output signal for the signal processing section and the noise reduction system. This joint output signal is forwarded to the receiver, which finally generates and outputs a corresponding output sound signal.

Whereas in the configuration with downstream combination the two output signals are simply combined to form a joint output signal, in the configuration with the audio input the first output signal is additionally looped through the noise reduction system and combined therein with the second output signal, in order to accordingly generate a joint output signal. The combination of the first and second output signals is thus provided once outside the noise reduction system and once inside it.

In an advantageous configuration the delay unit is fully integrated in the signal processing section and in particular arranged at the output thereof, so that the input signal is thus first modified and only then passes through the delay unit and is delayed, and is finally output as a delayed output signal. The modification unit is then in particular arranged upstream of the delay unit.

As an alternative to full integration in the signal processing section, the delay unit in a likewise advantageous configuration is split into multiple subunits, among which a first subunit is integrated in the signal processing section and a second, different subunit is integrated in the noise reduction system. In this case, the subunit in the signal processing section is expediently arranged at the output thereof, as already described, and the subunit in the noise reduction system is arranged at the audio input thereof, so that the delayed output signal from the signal processing section is delayed further on entering the noise reduction system. In this configuration the signal processing section thus delivers an input signal for the noise reduction system, similarly to in the case of a media player, in which the audio signal is routed to the noise reduction system via the audio input. In contrast to this, however, the input signal generated by the signal processing section—as already described earlier on—is correlated with the input signals from the microphones, which are likewise routed to the noise reduction system, since these are based on the same input sound signal or on similar input sound signals.

In an advantageous configuration with a delay unit having multiple subunits, one of the subunits, preferably the subunit in the signal processing section, produces a firmly predefined time difference and the other subunit, preferably the subunit in the noise reduction system, produces a time difference that is adjustable in a predefined range. All in all, the time difference of the delay unit is therefore made up of a static component, namely the predefined time difference, and a flexible component, namely the adjustable time difference. The static component advantageously produces a standard time difference, to which a flexible component is then added as required or from which a flexible component is deducted as required. By way of example, the flexible component is set on the basis of a degradation of a component of the hearing device, a temperature change, a change in the volume or the moisture in the auditory canal or the like. In general, the flexible component is thus used to react to changes in the hearing device or in the immediate surroundings thereof, in particular the auditory canal, during operation and to set the time difference in optimum fashion on the basis thereof. Alternatively or additionally, the flexible component is advantageously used to react to a changed delay time by connecting or disconnecting a supplementary function in the signal processing section.

As an alternative to the configuration with the static and flexible components in two subunits, a configuration in which the delay unit is fully integrated in the signal processing section and arranged at the output thereof, so that the input signal is first modified and only then passes through the delay unit and is delayed, and is finally output as a delayed output signal, and wherein the delay unit produces a time difference that is adjustable in a predefined range, so that the time difference of the delay unit is accordingly flexible, like the flexible component already described above, is also advantageous. However, a flexible component is now produced directly in the signal processing section and an additional static component is in particular not added. The flexible component is analogously set on the basis of a degradation of a component of the hearing device, a temperature change, a change in the volume or the moisture in the auditory canal or the like, for example. In general, the adjustable time difference is thus used to react to changes in the hearing device or the immediate surroundings thereof, in particular the auditory canal, during operation and to set the time difference in optimum fashion on the basis thereof.

The time difference is preferably set by virtue of the noise reduction system controlling the delay unit with a control signal or by virtue of the output signal from the noise reduction system being fed back to the delay unit and therefore being used directly as a control signal therefor, or both.

The hearing device described is what is known as a monaural hearing device and is used to look after just one side, i.e. one ear of the user. Two such hearing devices are expediently combined to form a binaural hearing device, however, which then has two monaural hearing devices as single devices for a respective side.

Other features which are considered as characteristic for the invention are set forth in the appended claims.

Although the invention is illustrated and described herein as embodied in a method for operating a hearing device and a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
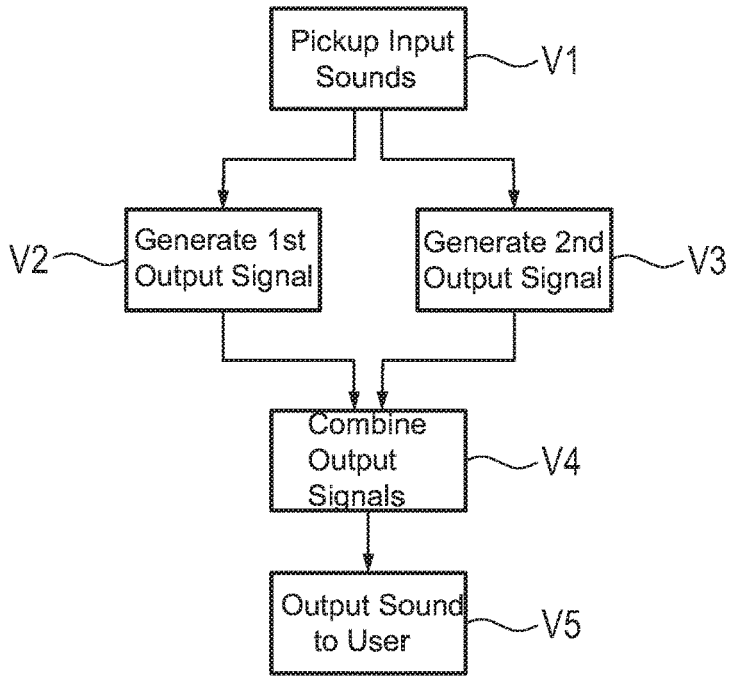
FIG. 1 is a flow chart showing a method for operating a hearing device according to the invention.

Referring now to the figures of the drawings in detail and first, particularly to FIG. 1 thereof, there is shown a method for operating a hearing device 2 in the form of a flowchart. Different variants of hearing devices 2 suitable therefor are shown in each of FIGS. 2 to 6. However, the invention is not restricted to the variants specifically shown, but these are preferred embodiments.

In general, the hearing device 2 has at least one microphone 4, 6 that picks up an input sound signal ES and converts it into an electrical input signal E1 in a method step V1. The hearing device 2 further has a signal processing section 8 that modifies the electrical input signal E1 on the basis of an audiogram of a user and thereby generates a first electrical output signal A1 in a method step V2. The input signal E1 here is modified in a modification unit 10, which is a part of the signal processing section 8. The hearing device 2 furthermore has an active noise reduction system 12 that generates a second electrical output signal A2, to reject a noise component, in a method step V3. The active noise reduction system 12 is also referred to as noise reduction system 12 in the present case for short. The noise reduction system 12 is operated in parallel with the signal processing section 8, as discernible from FIG. 1 in particular. The first and second electrical output signals A1, A2 are each also referred to as output signal A1, A2 for short. The two output signals A1, A2 are combined in a method step V4. The hearing device 2 moreover has a receiver 14 that converts the first electrical output signal A1 and the second electrical output signal A2 into a joint output sound signal AS, for output to the user, in a method step V5. The output sound signal AS is an acoustic output signal. The second electrical output signal A2 is in a form such that a noise component in the output sound signal AS is rejected. The noise component is for example an ambient sound and generally not a wanted signal. The noise component is a part either of the aforementioned input sound signal ES or of another input sound signal picked up by means of an additional microphone 16, 18.

In the case of the hearing devices 2 shown, the method for operating same involves an output sound signal AS being generated for the user of the hearing device 2 by virtue of an input sound signal ES first being picked up from the surroundings by means of multiple external microphones 4, 6. The respective microphone 4, 6 generates an electrical input signal E1 from the input sound signal ES. In FIG. 1, the two microphones 4, 6 thus generate two input signals E1, which are forwarded to the signal processing section 8. The signal processing section 8 modifies the input signals E1 and generates the first electrical output signal A1 therefrom. The modification is dependent on the individual hearing loss of the user and is affected on the basis of an individual audiogram stored for example in a memory of the hearing device 2, which is not shown in more detail. The output signal A1 is finally forwarded to the receiver 14, which is driven by the output signal A1 and outputs a corresponding acoustic output sound signal AS. In general, the procedure containing pickup of the input sound signal ES, generation of at least one input signal E1 therefrom, modification of the input signal, resultant generation of an output signal A1 and subsequent generation of the output sound signal AS is all in all a hearing device function that is a core functionality of the hearing device 2.

The active noise reduction system 12 behaves toward the signal path in a fundamentally similar manner to the signal processing section 8 for the hearing device function. The noise reduction system 12 likewise initially involves one or more input sound signals ES being picked up from the surroundings by means of one or more microphones 4, 6, 16, 18 in method step V1, these microphones 4, 6, 16, 18 not necessarily being the same as for the hearing device function. In this case too, the input sound signal ES typically has a noise component. The respective microphone 4, 6, 16, 18 generates from the input sound signal ES an electrical input signal E2 that accordingly also contains the noise component and that is forwarded to the noise reduction system 12. The latter analyses the input signal E2 in method step V3 and generates therefrom an electrical output signal, in particular the aforementioned second electrical output signal A2, which is then the opposite of the input signal E2 or at least portions thereof, specifically the noise component. The output signal A2 from the noise reduction system 12 is accordingly basically an inverted input signal E2. The output signal A2 is finally forwarded to the receiver 14 of the hearing device 2, which receiver is driven by the output signal A2 in method step V5 and outputs a corresponding output sound signal AS that is accordingly inverted with respect to the input sound signal ES and thereby cancels out, i.e. ultimately rejects, the noise component. The procedure containing pickup of the input sound signal ES, generation of the input signal E2 therefrom, analysis of the input signal, resultant generation of the output signal A2 to reject a noise component and subsequent generation of the output sound signal AS is all in all a noise reduction function.

The active noise reduction system 12 differs from the signal processing section 8 in the present case in that the noise reduction system aims to modify a sound signal and, to this end, actuates the receiver 14 accordingly, whereas the signal processing section aims to modify an electrical signal so that a specific sound signal is output. The noise component rejected by the noise reduction system 12 is outside the hearing device 2. The output sound signal AS from the noise reduction system 12 is output via the same receiver 14 as the output sound signal AS from the signal processing section 8. The receiver 14 is actuated both with the first and with the second output signal A1, A2, i.e. the output signals are overlaid and collectively supplied to the receiver 14, which then outputs them as output sound signal AS. Effectively, the receiver 14 is accordingly all in all actuated by means of a joint output signal A1+A2 and outputs a joint output sound signal AS. This output sound signal AS contains firstly a user component, which is generated for the user individually by the signal processing section 8 on the basis of the audiogram, and secondly a rejection component, which rejects noise components, i.e. perturbing sound signals e.g. from the surroundings or from the user, in the auditory canal. The cancellation of a noise component by the noise reduction system 12 accordingly takes place in the acoustic domain.

Two variants of the active noise reduction system 12 are combined with one another in the exemplary embodiments shown, but are also used independently of one another and individually in other variants, which are not shown. The first variant is an ANC (active noise cancelling), i.e. an active noise reduction system, which involves rejecting ambient sounds that enter the auditory canal from the outside and past an earmold that may be present for the hearing device 2 and represent a noise component. The input signal E2 is generated either using the same microphone 4, 6 as the input signal E1 for the signal processing section 8 or by means of another, additional microphone 16, 18. The second variant is an AOR (active occlusion reduction), which involves rejecting sounds in the auditory canal, above all inherent sounds, i.e. sound signals that are produced by the user himself, or standing waves inside a predominately sealed auditory canal. In this instance, the input signal E2 for the noise reduction system 12 is generated by means of an internal microphone 18 and not using the microphones 4, 6 that generate the input signal E1 for the signal processing section 8 and also not using the external microphone 16. In the case of the ANC the microphone 4, 6, 16 is accordingly directed outward, whereas in the case of the AOR the microphone 18 is directed inward.

In order to provide both a hearing device function and a noise reduction function in the hearing device 2, the signal processing section 8 and the active noise reduction system 12 are operated in parallel in the present case. This is understood to mean that the signal processing section 8 and the active noise reduction system 12 are operated independently of one another, i.e. they form two mutually separate processing blocks inside the hearing device 2, as is also evident from FIGS. 2 to 6. The signal processing section 8 and the active noise reduction system 12 are each in the form of an electronic circuit and the two circuits are arranged for example at different points on a microchip or on different microchips. The active noise reduction system 12 is not part and not a subfunction of the signal processing section 9 and operates independently thereof in principle. The parallel operation means that the active noise reduction system 12 thus does not intervene in the modification of the input signal E1 by the signal processing section 8, and conversely the signal processing section 8 also does not intervene in the generation of the output signal A2 from the noise reduction system 8. The hearing device function and the noise reduction function are therefore implemented as parallel processes in the hearing device 2.

The signal processing section 8 requires a certain processing time in order to modify the input signal E1 and for method step V2 in general. The noise reduction system 12 similarly requires a certain processing time in order to analyse the input signal E2 and in order to output the output signal A2 and for method step V3 in general. This respective processing time is ideally as short as possible, in order to avoid a delayed output as far as possible. In connection with the signal processing section 8, at least a portion of the input sound signal ES normally enters the auditory canal of the user and is overlaid with the output sound signal AS. Due to the delay time of the signal processing section 8, the input sound signal ES and the output sound signal AS are offset in time by a time lag. If the processing time is too long, then the time lag is perceptible to the user and is typically sensed as a nuisance. In the noise reduction system 12, the output sound signal AS inherently needs to be overlaid with the input sound signal ES in a specific manner in order to obtain a maximum effect, that is to say maximum cancellation. Any delay before the output sound signal AS is output leads to an additional phase shift between said output sound signal and the input sound signal ES, with the result that the overlay is not optimum and the cancellation is accordingly incomplete. The processing time of the signal processing section 8 is no more than 2 ms, for example. The processing time of the noise reduction system 12, whether ANC or AOR or both, is 100 μs is to 150 μs, for example.

In each of the exemplary embodiments shown, the hearing device 2 has a delay unit 20, in order to set a time difference between the first output signal A1 and the second output signal A2. The hearing device 2 therefore has an adjustable time difference, for which either a firm value is predefined and the delay unit 20 is then either activated or deactivated or which is adjustable within a predefined range. For this purpose, the delay unit 20 has a ring buffer or is in the form of a ring buffer, for example. The delay unit 20 is used by and large to reduce a correlation between the output signals A1, A2. For the purpose of controlling the delay unit 20 and for the purpose of setting the time difference, the hearing device 2 has a correlation measurement unit, for example, not shown in more detail, which determines a correlation between the first and second output signals A1, A2 and actuates the delay unit 20 so that a time difference that minimizes the correlation is set. In the present case, the time difference is set in a range from 2 ms to 5 ms.

In a variant, the time difference is activated only in a rejection mode of the hearing device 2 and is otherwise, e.g. in a normal mode, deactivated. In the rejection mode, the active noise reduction system 12 is activated, otherwise, and specifically in the normal mode, it is deactivated, however.

In the normal mode, the time difference is then chosen to be as small as possible, so that only the delay time remains for the signal processing section, i.e. a delay between the input signal E1 and the output signal A2 is as short as possible, and hence the best possible hearing experience is ensured. In the rejection mode, on the other hand, the additional time difference is consciously added to the processing time of the signal processing section 8, so that the interference and correlation effects that potentially occur are reduced.

An alternative or additional possibility is also a variant in which the hearing device 2 has multiple modes of operation in which the signal processing section 8 has a different processing time in each case, and wherein the time difference added by the delay unit 20 is then set on the basis of the mode of operation and hence on the basis of the respective processing time of the signal processing section 8. In a variant, the time difference is then set in the respective mode of operation to be greater the shorter the respective processing time.

As becomes clear from FIGS. 2 to 6, parallel operation of the signal processing section 8 and the active noise reduction system 12 can be implemented in different ways. Different suitable configurations are obtained in particular in respect of the following three aspects: first, by the selection of microphones 4, 6, 16, 18 and the respective connection thereof to the signal processing section 8 and the noise reduction system 12. Second, by the type of combination of the two output signals A1, A2. Third, by the specific configuration, arrangement and control of the delay unit 20. In addition to the variants shown, other variants, which are not shown, exist that are obtained through different combination of the various configurations in respect of the three cited aspects.

Figure 2:
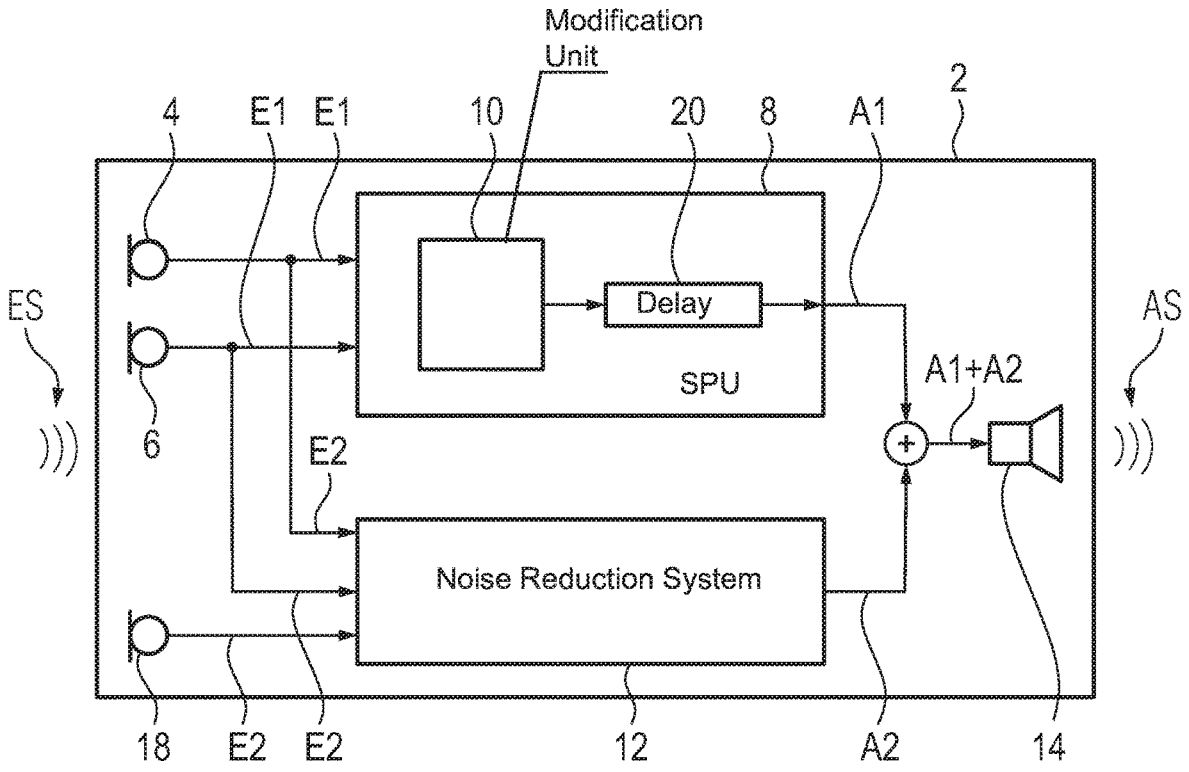
FIG. 2 is a block diagram showing a hearing device.

In FIG. 2 the hearing device 2 has two external microphones 4, 6, which each generate an input signal E1, E2 that is forwarded as input signal E1 to the signal processing section 8 and as input signal E2 also to the noise reduction system 12. The signal processing section 8 generates the first output signal A1 on the basis of the two input signals E1 from the external microphones 4, 6 and the noise reduction system 12 generates the second output signal A2 on the basis of the same two input signals E2 from the external microphones 4, 6.

By contrast, the hearing device 2 in FIGS. 3 to 6 has two external microphones 4, 6, which each generate an input signal E1, and a further external microphone 16, which generates an input signal E2. The input signals E1 are forwarded exclusively to the signal processing section 8, while the other input signal E2 is forwarded exclusively to the noise reduction system 12. The signal processing section 8 generates the first output signal A1 on the basis of the input signals E1 and the noise reduction system 12 generates the second output signal A2 on the basis of the other input signal E2.

In comparison with the configuration in FIG. 2, in which the same input signal E1, E2 is forwarded both to the signal processing section 8 and to the noise reduction system 12, the signal processing section 8 and the noise reduction system 12 in FIGS. 3 to 6 use the input signals E1, E2 from different external microphones 4, 6, 16, so that there is already a reduced correlation at the input.

Given the aforementioned use of an input signal E2 from one or more external microphones 4, 6, 16, it has been assumed that the noise reduction system 12 is an ANC. In the present case, the noise reduction system 12 is additionally also an AOR and uses a further input signal E2 from an internal microphone 18 of the hearing device 2. The noise reduction system 12 in the present case thus generates the output signal A2 on the basis of one or more input signals E2 from external microphones 4, 6, 16 and additionally also on the basis of an input signal E2 from an internal microphone 18. The configurations having external microphones 4, 6, 16 are arbitrarily combinable with the configuration having an internal microphone 18. In principle, a single external microphone 4, 6, 16 is also already sufficient, at least for a hearing device having ANC. For a hearing device having AOR, at least one internal microphone 18 is additionally required.

Figure 3:
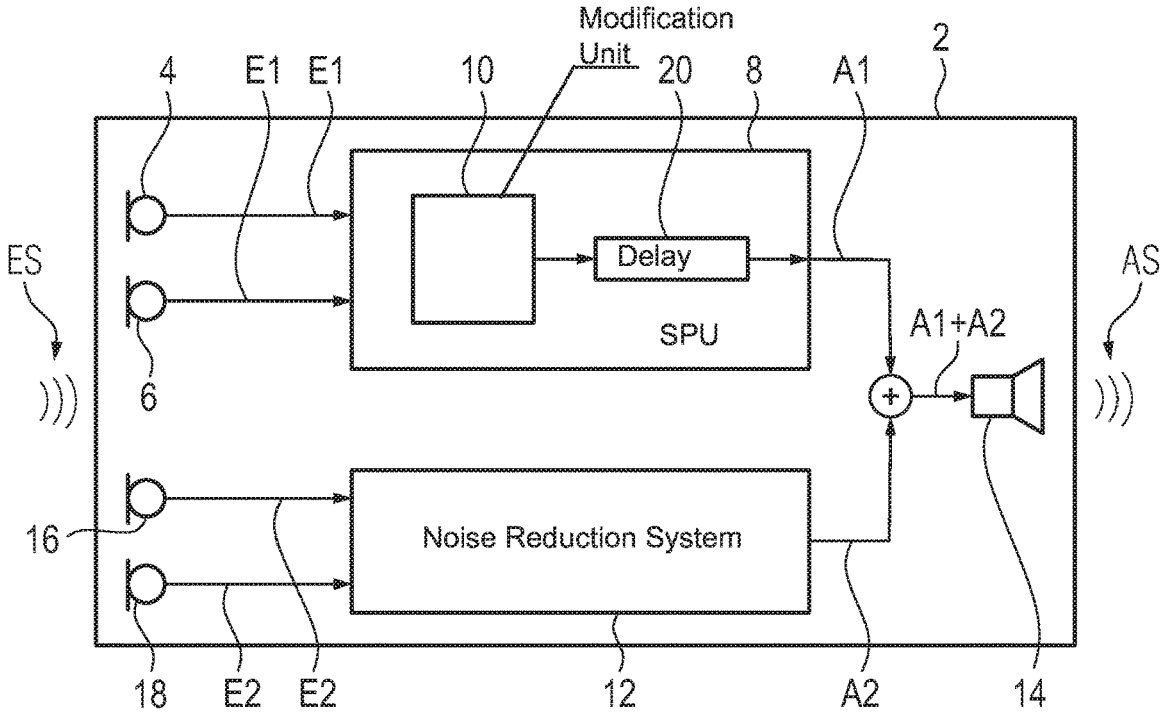
FIG. 3 is a block diagram showing a variant of the hearing device from FIG. 2.
Figure 4:
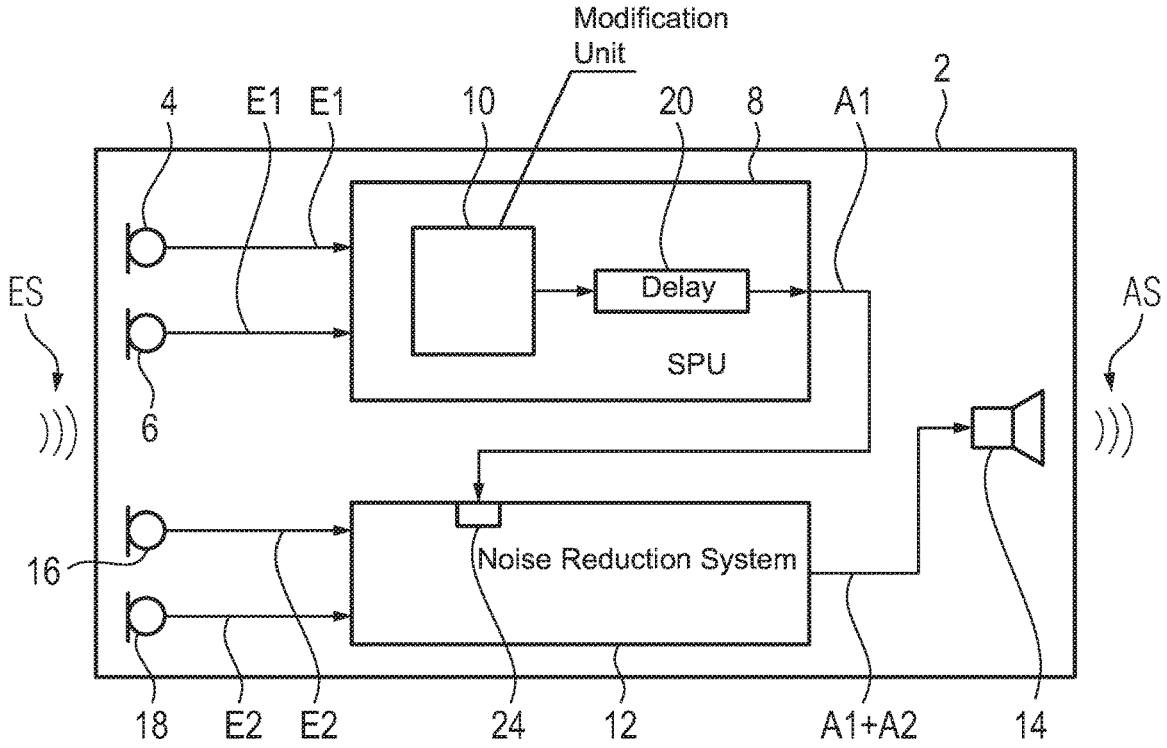
FIG. 4 is a block diagram showing a further variant of the hearing device from FIG. 2.

In the exemplary embodiments of FIGS. 2 and 3 the first output signal A1 and the second output signal A2 are combined with one another, in this case added, outside the signal processing section 8 and the noise reduction system 12 and are forwarded to the receiver 14, which finally generates and outputs a corresponding output sound signal AS. The combination is effected by means of an adder, for example, which is not shown in more detail. By contrast, the noise reduction system 12 in FIGS. 4 to 6 has an audio input 24 by way of which the first output signal A1 from the signal processing section 8 is routed to the noise reduction system 12, so that the first output signal A1 is a further input signal, as it were, for said noise reduction system. The second output signal A2 is then generated in the noise reduction system 12 on the basis of the input signals E2 from the microphones 4, 6, 16, 18 and combined with the first output signal A1, so that the noise reduction system 12 then outputs a joint output signal A1+A2 for the signal processing section 8 and the noise reduction system 12. This joint output signal A1+A2 is forwarded to the receiver 14, which finally generates and outputs a corresponding output sound signal AS. Whereas in the configuration of FIGS. 2 and 3 with downstream combination the two output signals A1, A2 are simply combined to form a joint output signal A1+A2, in the configuration of FIGS. 4 to 6 with the audio input 24 the first output signal A1 is additionally looped through the noise reduction system 12 and combined therein with the second output signal A2, in order to accordingly generate a joint output signal A1+A2. The combination of the first and second output signals A1+A2 is thus provided once outside the noise reduction system and once inside it.

The delay unit 20 in the exemplary embodiments of FIGS. 2 to 4 and 6 is fully integrated in the signal processing section 8 and, in the present case, even arranged at the output thereof, so that the input signal E1 is thus first modified by means of the modification unit 10 and only then passes through the delay unit 20 and is delayed, and is finally output as a delayed output signal A1.

Figure 5:
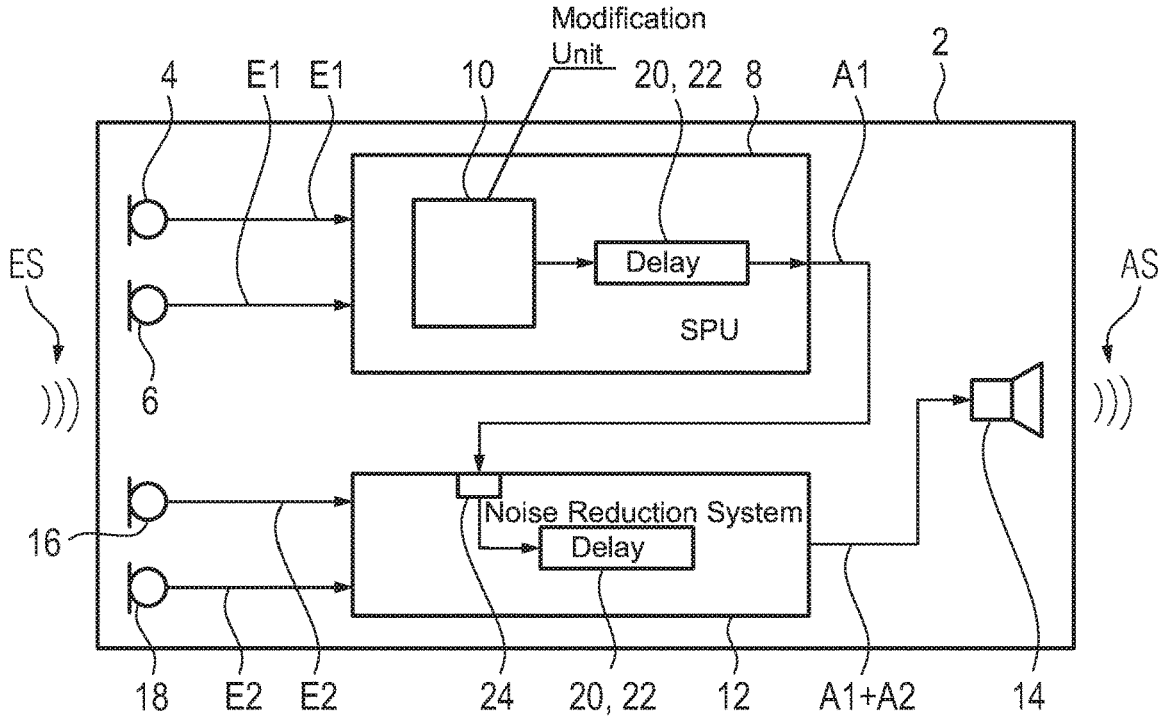
FIG. 5 is a block diagram showing a further variant of the hearing device from FIG. 2.

As an alternative to full integration in the signal processing section 8, the delay unit 20 in the exemplary embodiment of FIG. 5 is split into multiple subunits 22, among which one is integrated in the signal processing section 8 and another is integrated in the noise reduction system 12. In this case, the subunit 22 in the signal processing section 8 is arranged at the output thereof and the subunit 22 in the noise reduction system 12 is arranged at the audio input 24 thereof, so that the delayed output signal A1 from the signal processing section 8 is delayed further on entering the noise reduction system 12. In the present case the subunit 22 in the signal processing section 8 produces a firmly predefined time difference and the other subunit 22 in the noise reduction system 12 produces a time difference that is adjustable in a predefined range. The arrangement may alternatively be the other way round. All in all, the time difference of the delay unit 20 is therefore made up of a static component, namely the predefined time difference, and a flexible component, namely the adjustable time difference.

Figure 6:
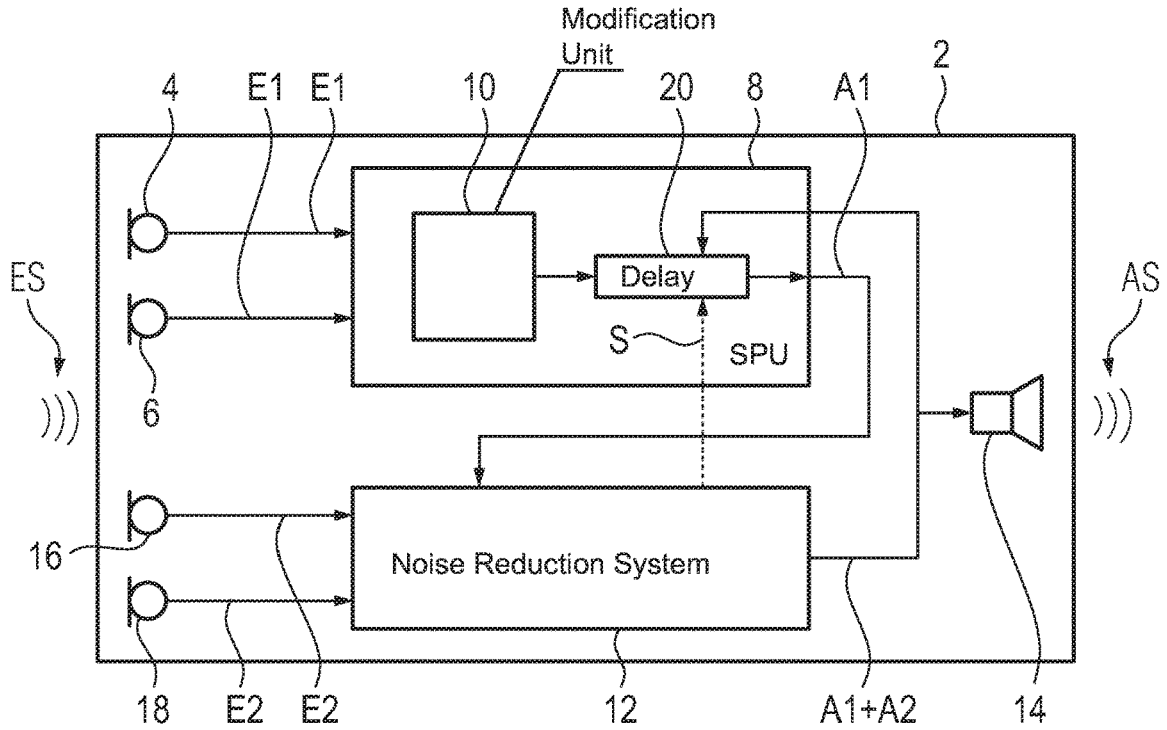
FIG. 6 is a block diagram showing a further variant of the hearing device from FIG. 2.

In the exemplary embodiment of FIG. 6 the delay unit 20 is fully integrated in the signal processing section 8 and produces a time difference that is adjustable in a predefined range, so that the time difference of the delay unit 20 is accordingly flexible, like the flexible component already described above. However, a flexible component is now produced directly in the signal processing section 8 and an additional static component is in particular not added here. Additionally, the time difference in FIG. 6 is set by virtue of the noise reduction system 12 controlling the delay unit 20 with a control signal S or by virtue of the output signal A1+A2 from the noise reduction system 12 being fed back to the delay unit 20 and therefore being used directly as a control signal therefor. Both variants are shown in FIG. 6, but are also implementable independently of one another.

The following is a summary list of reference numerals and the corresponding structure used in the above description of the invention:

2 hearing device
4 microphone
6 microphone
8 signal processing section
10 modification unit
12 noise reduction system
14 receiver
16 microphone
18 microphone
20 delay unit
22 subunit (of the delay unit)
24 audio input
A1 first electrical output signal (of the signal processing section)
A2 second electrical output signal (of the noise reduction system)
A1+A2 joint output signal (sum of A1 and A2)
AS output sound signal
E1 first electrical input signal (for the signal processing section)
E2 second electrical input signal (for the noise reduction system)
ES input sound signal
S control signal
V1 to V5 method step

The invention claimed is:

1. A method for operating a hearing device having at least one microphone, a signal processing section, an active noise reduction system, a delay unit, and a receiver, which comprises the steps of:

picking up an input sound signal, via the at least one microphone, and converting the input sound signal into an electrical input signal;

modifying, via the signal processing section, the electrical input signal on a basis of an audiogram of a user and thereby generating a first electrical output signal;

generating, via the active noise reduction system, a second electrical output signal in order to reject a noise component, wherein the active noise reduction system is operated in parallel with the signal processing section;

setting a time difference between the first electrical output signal and the second electrical output signal via the delay unit; and converting, via the receiver, the first electrical output signal and the second electrical output signal into an output sound signal, for output to the user.

2. The method according to claim 1, wherein the active noise reduction system is an active noise cancellation system, an active occlusion reduction system or an ANC and AOR system.

3. The method according to claim 1, wherein the time difference is set in a range from 2 ms to 5 ms.

4. The method according to claim 1, wherein:

the hearing device has two modes of operation, namely a rejection mode, in which the active noise reduction system is activated, and a normal mode, in which the active noise reduction system is deactivated; and the time difference of the delay unit is set such that a delay between the electrical input signal of the signal processing section and the first electrical output signal thereof is greater in the rejection mode than in the normal mode.

5. The method according to claim 1, wherein:

the hearing device has multiple modes of operation in which the signal processing section has a different processing time in each case; and the time difference added by the delay unit is set on a basis of a mode of operation and hence on a basis of a respective processing time.

6. The method according to claim 1, wherein:

the at least one microphone generates the electrical input signal that is forwarded both to the signal processing section and to the noise reduction system; and the signal processing section generates the first electrical output signal and the noise reduction system generates the second electrical output signal on a basis of the electrical input signal.

7. The method according to claim 1, wherein:

the at least one microphone is one of at least two external microphones including a first external microphone and a second external microphone; and the external microphones generate electrical input signals including a first input signal and a second input signal, one of the first and second electrical input signals is forwarded to the signal processing section, while the other is forwarded to the noise reduction system.

8. The method according to claim 1, wherein the hearing device has a further internal microphone that generates a further input signal that is supplied to the noise reduction system, which then generates the second electrical output signal on a basis of the further input signal from the further internal microphone.

9. The method according to claim 1, wherein the first electrical output signal and the second electrical output signal are combined with one another outside the signal processing section and the noise reduction system and are forwarded to the receiver, which finally generates and outputs the output sound signal.

10. The method according to claim 1, wherein:

the noise reduction system has an audio input by way of which the first electrical output signal of the signal processing section is routed to the noise reduction system;

the second electrical output signal is generated in the noise reduction system and combined with the first electrical output signal, so that the noise reduction system outputs a joint output signal for the signal processing section and the noise reduction system; and the joint output signal is forwarded to the receiver, which finally generates and outputs the output sound signal.

11. The method according to claim 1, wherein the signal processing section of the hearing device has a processing time of no more than 1 ms.

12. A method for operating a hearing device having at least one microphone, a signal processing section, an active noise reduction system and a receiver, which comprises the steps of:

picking up an input sound signal, via the at least one microphone, and converting the input sound signal into an electrical input signal;

modifying, via the signal processing section, the electrical input signal on a basis of an audiogram of a user and thereby generating a first electrical output signal, wherein the signal processing section of the hearing device has a processing time of no more than 2 ms;

generating, via the active noise reduction system, a second electrical output signal in order to reject a noise component, wherein the active noise reduction system is operated in parallel with the signal processing section; and converting, via the receiver, the first electrical output signal and the second electrical output signal into an output sound signal, for output to the user.

13. A method for operating a hearing device having at least one microphone, a signal processing section, an active noise reduction system and a receiver, which comprises the steps of:

picking up an input sound signal, via the at least one microphone, and converting the input sound signal into an electrical input signal;

modifying, via the signal processing section, the electrical input signal on a basis of an audiogram of a user and thereby generating a first electrical output signal;

fully integrating a delay unit in the signal processing section, so that the electrical input signal is first modified and only then passes through the delay unit and is delayed, and is finally output as the first electrical output signal being a delayed output signal;

generating, via the active noise reduction system, a second electrical output signal in order to reject a noise component, wherein the active noise reduction system is operated in parallel with the signal processing section; and converting, via the receiver, the first electrical output signal and the second electrical output signal into an output sound signal, for output to the user.

14. The method according to claim 13, wherein:

the delay unit is split into a plurality of subunits, among which a first subunit is integrated in the signal processing section and another, second subunit is integrated in the noise reduction system; and one of the subunits produces a firmly predefined time difference and the other subunit produces a time difference that is adjustable in a predefined range.

15. A hearing device, comprising:

at least one microphone;

a signal processing section;

an active noise reduction system; and a receiver;

the hearing device configured to perform a method according to claim 1.

* * * * *